United States Patent [19]

Arakawa et al.

[11] Patent Number: 4,753,741

[45] Date of Patent: Jun. 28, 1988

[54] SUPER HIGHLY RADIATION-RESISTANT GREASE

[75] Inventors: Kazuo Arakawa, Gunma; Tsuneo Sasuga, Gunma; Miyuki Hagiwara, Gunma; Naohiro Hayakawa, Gunma; Kenzo Yoshida, Gunma; Hiroshi Nakanishi, Hyogo; Mitsuo Hirohama, Hyogo; Tetsuya Yagi, Osaka; Tamio Akada, Hyogo; Takao Soda, Hyogo, all of Japan

[73] Assignees: Japan Atomic Energy Research Institute, Tokyo; Matsumura Oil Research Corporation, Hyogo, both of Japan

[21] Appl. No.: 49,959

[22] Filed: May 15, 1987

[30] Foreign Application Priority Data

May 27, 1986 [JP] Japan ..... 61-121895

[51] Int. Cl.[4] ..... C10M 103/00; C10M 113/10; C10M 125/30

[52] U.S. Cl. ..... 252/25; 252/18

[58] Field of Search ..... 44/25; 252/42.7, 49.7

[56] References Cited

U.S. PATENT DOCUMENTS

| | | | |
|---|---|---|---|
| 3,231,497 | 1/1966 | Koch | 252/42.7 |
| 3,245,907 | 4/1966 | Stark | 252/49.7 X |
| 3,274,220 | 9/1966 | Budde | 252/49.7 X |
| 3,290,247 | 12/1966 | Wilson | 252/42.7 |
| 3,290,249 | 12/1966 | Wilson | 252/25 X |
| 3,350,307 | 10/1967 | Brown | 252/25 X |
| 4,122,022 | 7/1983 | MacKenzie | 252/28 |
| 4,211,662 | 7/1980 | King | 252/28 X |

*Primary Examiner*—William R. Dixon, Jr.
*Assistant Examiner*—James M. Hunter, Jr.
*Attorney, Agent, or Firm*—Browdy and Neimark

[57] ABSTRACT

A radiation-resistant grease that is stable under elevated temperatures is disclosed. The grease is prepared by mixing a bentonite-based thickening agent with a base oil composed of m-(m-phenoxyphenoxy)diphenyl, pentaphenyl ether, a monoalkyltriphenyl ether or a monoalkyltetraphenyl ether (provided that the alkyl group contains 6–20 carbon atoms). To the mixture is added, if necessary, a gelling aid composed of an aliphatic alcohol, an aliphatic ketone and/or an aliphatic carbonate ester.

4 Claims, No Drawings

SUPER HIGHLY RADIATION-RESISTANT GREASE

BACKGROUND OF THE INVENTION

The present invention relates to a grease having improved radiation resistance. More particularly, the present invention relates to a radiation-resistant grease which has bentonite (thickening agent) and an alcohol, ketone or ester (gelling aid) incorporated in a base oil which is made of either m-(m-phenoxyphenoxy)diphenyl, pentaphenyl ether, a monoalkyltriphenyl ether or a monoalkyltetraphenyl ether.

Grease is employed in various machines at nuclear facilities such as power plants and fuel reprocessing plants, or at irradiation facilities such as cobalt-irradiating equipment and nuclear accelerators, and is subjected to two types of deterioration, one resulting from aging and the other caused by radiation exposure. The deteriorated grease is replaced at the time of periodic inspections and at other suitable occasions but the frequency of grease replacement is desirably held to a minimum in order to improve the degree of capacity utilization of the facilities and to reduce the frequency of exposure to radiation on the part of person. A situation therefore exists to require the development of a grease having superior resistance to radiation.

The greases currently employed in machines at nuclear facilities are roughly divided into two types: the silica gel grease that uses a petroleum based lubricant as a base oil, and the soap base grease that incorporates a petroleum based lubricant or a synthetic oil as a base oil. However, these conventional greases are not possessed of adequate resistance to radiation. If the silica gel grease using a petroleum based lubricant as a base oil is employed in machines at a high dose-rate irradiation site, the base oil solidifies as a result of radiation-induced polymerization and its lubricating property is lost within a short time to cause premature wear of the machine. On the other hand, the soap base grease which uses a petroleum based lubricant or a synthetic oil as a base oil will be softened as a result of exposure to an increased dose of radiation, and the fluidized grease will leak out of the machine. A possible cause of these phenomena is the loss of radiation resistance not only of the base oil and the thickening agent present in the grease but also of the gel structure which is formed as a result of interaction between the base oil and the thickening agent. It would therefore be clear that in order to provide a grease with enhanced radiation resistance, it is important that not only a base oil and a thickening agent having improved radiation resistance should be used but also the characteristic gel structure formed as a result of interaction between the base oil and the thickening agent should be stable to radiation.

The present invention has been accomplished in order to develop a highly radiation-resistant grease which is free from the defects of the conventional products.

The present inventors previously filed a patent application on a radiation-resistant grease that employed a mixed base oil having a low pour point and which performed satisfactorily at low temperatures (Japanese Patent Application No. 114657/1985). In this present invention, emphasis is placed on achieving better performance at high temperatures and its principal purpose is to develop a grease that employs a base oil made of a highly heat-resistant single component and which exhibits superior radiation resistance at elevated temperature.

The present inventors reported the superior radiation resistance of m-(m-phenoxyphenoxy)diphenyl and pentaphenyl ether oils in Journal of the Society of Atomic Energy of Japan, 26, 8, 718 (1984). In preparing a grease that is resistant to both heat and radiation, it is of course important to employ a base oil having high resistance to radiation but at the same time, it is indispensable to select a thickening agent that is not only heat- and radiation-resistant but also compatible with the base oil. Few reports have been made of greases using m-(m-phenoxyphenoxy)diphenyl as a base oil and there are no observations available that provide an immediate practical guide for choosing a thickening agent that is adapted for the preparation of a grease having high degrees of radiation- and heat-resistance.

The present inventors prepared three samples of grease that employed m-(m-phenoxyphenoxy)diphenyl as a base oil but which contained different thickening agents, i.e., urea, silica gel and bentonite. When these samples were irradiated with gamma-rays from $^{60}Co$ for a total dose of 5,000 Mrad as room temperature, the greases using urea or silica gel as a thickening agent were liquefied but, on the other hand, the grease using bentonite remained almost intact and even after exposure to twice the dose level (10,000 Mrad), this grease experienced very small variations in worked penetration, oil separation, free acid content and dropping point. The greases employing urea or silica gel as a thickening agent were also liquefied when they were irradiated with gamma-rays for a total dose of 500 Mrad at 150° C. but the grease using bentonite remained intact even in this case.

The present inventors found that equally good results were attained by using bentonite as a thickening agent when the base oil was made of pentaphenyl ether, a monoalkyltriphenyl ether or a monoalkyltetraphenyl ether rather than m-(m-phenoxyphenoxy)diphenyl. In addition, these greases exhibited the high levels of radiation resistance ($\geqq$10,000 Mrad) that could not have been expected from the case of using the above-mentioned base oils alone, and this demonstrates the appreciable improvement in radiation resistance that was attained by using bentonite as a thickening agent. The reason for this effect is not completely clear but presumably the bentonite will form a special gel structure that is highly resistant to radiation.

The present invention has been accomplished based on the confirmation of the following findings: a grease having high radiation resistance can be attained from a composition that is basically the combination of a bentonite-based thickening agent and a base oil selected from among m-(m-phenoxyphenoxy)diphenyl, pentaphenyl ether, a monoalkyltriphenyl ether and a monoalkyltetraphenyl ether and which optionally contains at least one gelling aid selected from an alcohol, a ketone and a carbonate ester; this grease exhibits a superior performance when used in a mechanical snubber, a limit switch or any other devices that are to receive large doses of radiation or which are to be used in radioactive fields and at high temperatures.

SUMMARY OF THE INVENTION

The general object, therefore, of the present invention is to provide a radiation-resistant grease that is based on an oil composed of either m-(m-phenoxyphenoxy)diphenyl, pentaphenyl ether, a monoalkyltriphenyl ether or a monoalkyltetraphenyl ether, and which contains a bentonite-based thickening agent and an alcohol, ketone or carbonate ester as a gelling aid.

In accordance with one aspect, the present invention provides a radiation-resistant grease which consists essentially of:

(A) 70 to 97 wt% of a base oil composed of the following component: either m-(m-phenoxyphenoxy)-diphenyl, pentaphenyl ether, a monoalkyltriphenyl ether or a monoalkyltetraphenyl ether, provided that the alkyl group has 6–20 carbon atoms; and (B) 3 to 30 wt% of a bentonite based thickening agent.

In accordance with another aspect, the present invention provides a radiation-resistant grease which consists essentially of:

(A) 60 to 96.5 wt% of a base oil composed of the following component: either m-(m-phenoxyphenoxy)-diphenyl, pentaphenyl ether, a monoalkyltriphenyl ether or a monoalkyltetraphenyl ether, provided that the alkyl group has 6–20 carbon atoms;

(B) 3 to 30 wt % of a bentonite based thickening agent; and (C) 0.5 to 10 wt % of at least one gelling aid selected from the group consisting of an aliphatic alcohol having 1–5 carbon atoms, an aliphatic ketone having 3–8 carbon atoms and an aliphatic carbonate ester having 2–5 carbon atoms in the aliphatic group.

DETAILED DESCRIPTION OF THE PREFERRED EMBODIMENT

The radiation-resistant grease in accordance with the first aspect of the present invention contains, when it is being prepared, 0.5–10 wt % of a gelling aid selected from the group consisting of an aliphatic alcohol having 1–5 carbon atoms and an aliphatic ketone having 3–8 carbon atoms, together with the other necessary components (1) and (2), and at the last stage of preparation, the alcohol and/or ketone are removed by, for example, evaporation under vacuum, to thereby produce a grease which is substantially composed of the base oil (A) and the thickening agent (B).

In accordance with the first aspect of the present invention, the base oil is used in an amount of 70 to 98 wt %, preferably 80 to 90 wt %, of the final grease, while in accordance with the second aspect of the invention, the base oil is employed in an amount of 60 to 96.5 wt %, preferably 80 to 90 wt %, of the final grease.

The present inventors have found that if the base oil specified above is mixed with a bentonite-based thickening agent in the presence of an appropriate gelling aid, it forms a gel structure which is stable to radiation exposures, thus providing a grease that has and maintains an appropriate degree of worked penetration while exhibiting a high dropping point and enhanced resistance to oxidation. In order to attain these effects, the bentonite-based thickening agent should be incorporated in an amount of 3 to 30 wt % of the grease, with the range of 10 to 18 wt % being preferable. Examples of the bentonite-based thickening agent that may be used in the present invention include Bentone 27, Bentone 34, Bentone 38, Bentone SD-1 and Bentone SD-2 (Bentone is the trademark of N. L. Industries), and New D Orbene (Orbene is the trademark of Shiraishi Kogyo K.K.)

The gelling aid used in the present invention assists the base oil (i.e., composed of either the m-(m-phenoxyphenoxy)diphenyl, pentaphenyl ether, monoalkyltriphenyl ether, or monoalkyltetraphenyl ether) and the bentonite-based thickening agent in forming a gel structure which is stable to radiation exposures, and this gelling aid is at least one compound selected from the group consisting of an aliphatic alcohol having 1–5 carbon atoms, an aliphatic ketone having 3–8 carbon atoms, and an aliphatic carbonate ester having 2–5 carbon atoms in the aliphatic group.

Usable aliphatic alcohols are methyl alcohol, ethyl alcohol, propyl alcohol, isopropyl alcohol, butyl alcohol, sec-butyl alcohol, t-butyl alcohol and amyl alcohol. Usable aliphatic ketones are acetone, diethyl ketone, di-n-propyl ketone, diisopropyl ketone, methyl ethyl ketone, methyl propyl ketone, methyl butyl ketone, methyl-sec-butyl ketone, methyl amyl ketone and ethyl amyl ketone. Usable aliphatic carbonate esters are those esters which derive from alkenes and carbonic acid, such as ethylene carbonate, propylene carbonate, butene carbonate, pentene carbonate, and 3-methylbutene carbonate.

The above-listed alcohols, ketones and esters may be used either independently or in combination. They are added in amounts ranging from 0.5 to 10 wt %, preferably 0.5 to 5 wt %, more preferably 1 to 3 wt %, of the grease.

Although it is essential that the grease of the present invention satisfies the aforementioned requirements for the components and their proportions, the compounds used as the gelling aid are more or less volatile and may evaporate during storage or service. However, once the stable gel structure has formed, subsequent evaporation of the gelling aid is by no means detrimental to the performance of the grease. Therefore, it should be understood that the grease of the present invention allows for a change in its composition resulting from the evaporation of the gelling aid during storage or use.

Alcohols and/or ketones used as a gelling aid in the present invention may catch fire and they additionally have characteristic odors. Therefore, such alcohols and/or ketones are preferably removed at the final stage of grease preparation by evaporation under vacuum and/or heating. In this case, the grease of the present invention in its final product form is substantially free of the gelling aid and composed solely of the base oil and the bentonite-based thickening agent. If an ester is used as the gelling aid, it does not need to be removed.

The grease of the present invention may be readily produced by a standard method which proceeds as follows: a predetermined amount of the base oil is mixed with a predetermined amount of the bentonite thickening agent. Mixing may be effected with a conventional mixer, say, a double planetary mixer. Ambient temperature is typically used, but mixing under elevated temperatures up to about 100° C. is acceptable. A period of about 1 to 3 hours is generally sufficient to achieve uniform mixing.

Subsequently, a predetermined amount of the gelling aid is added to the mixture and the respective components are then well mixed under agitation at a temperature ranging from ambient temperature up to less than the boiling point of the gelling aid (e.g. ca. 60°–90° C. if the gelling aid is propylene carbonate).

The resulting mixture is then homogenized by a standard method using a speedline mill, homogenizer or rolling. The homogenizing temperature and period generally range from 50° to 120° C. and from 10 to 60 minutes, respectively. By this homogenizing treatment, the base oil interacts with the thickening agent to form the desired gel structure and yield a grease having the desired degree of radiation resistance.

If and alcohol and/or ketone is used as the gelling aid, the resulting grease may optionally be treated under vacuum so as to remove the alcohol and/or ketone by evaporation. Satisfactory results are obtained by reducing the pressure to about 1–2 Torr and maintaining this level of pressure for a period of no longer than about 1 hour, typically within the limits of about 10 and 20 minutes. Evaporation of the gelling aid is preferably accomplished by means of vacuum but it may be performed by heating the grease to an elevated temperature not exceeding 150° C.

If the components specified above are used in the amounts also specified above and the blend is treated by the procedures shown above, a high dropping point radiation-resistant grease is obtained and, as will be demonstrated by the Examples given below, this grease maintains an appropriate degree of worked penetration and will not experience destruction of the gel structure to any significant extent even if it is exposed to radiation, and additionally, this grease undergoes an extremely low level of oxidative degradation.

The following working examples and comparative examples are provided for the purpose of further illustrating the construction and advantages of the present invention and are by no means to be taken as limiting.

EXAMPLE 1

To an intimate mixture of m-(m-phenoxyphenoxy)-diphenyl (890 g) and Bentone 34 (100 g), 10 g of propylene carbonate was added, and the resulting mixture was agitated for 3 hours at 70° C. The mixture was then treated in a speedline mill to prepare 950 g of a grease.

The grease was spread onto a glass plate (20 cm ×20 cm ×1.5 mm) to form a coat in a thickness of 1 mm. The grease coat was irradiated with gamma-rays from $^{60}$Co at a dose rate of 1 Mrad/hr to give a total dose of 1,000, 3,000, or 10,000 Mrad. The properties of the grease being measured before and after the irradiation are shown in Table 3. The grease was also spread on the bottom of a petri dish (height, 17 mm; i.d., 86 mm) to form a coat having a thickness of 6 mm. After the petri dish was closed with a larger petri dish (height, 23 mm; i.d., 116 mm), the grease coat was irradiated with gamma-rays from $^{60}$Co at a dose rate of 1 Mrad/hr to give a total dose of 500 Mrad at 150° C. The properties of the grease as measured before and after the irradiation are shown in Table 4. The values of worked penetration, oil separation (100° C.×24 hours), dropping point and percentage of free acid given in Tables 3 and 4 were obtained by measurements in accordance with JIS K2220.

EXAMPLES 2–7 AND COMPARATIVE EXAMPLES 1–9

Greases having the compositions shown in Table 2 were prepared by repeating the procedures of Example 1. The results of tests conducted on these greases as in Example 1 are summarized in Tables 3 and 4.

The data in Table 3 show the superiority of the greases of the present invention as compared to commercial products of radiation-resistant grease (Comparative Examples 5–9): the former experienced smaller changes in worked penetration as a result of radiation exposure; the degree of oil separation and the dropping point which are a measure for the destruction of gel structure remained substantially constant; and the formation of free acids which is indicative of the oxidative degradation of oils only occurred at low levels.

The samples prepared in Comparative Examples 1 to 4 were solely composed of m-(m-phenoxyphenoxy)-diphenyl, pentaphenyl ether, a monoalkyltriphenyl ether and a monoalkyltetraphenyl ether, respectively. These oils had good radiation resistance but as Table 1 shows, they experienced significant increases in viscosity when they were given a total exposure of 3,000 Mrad in the air in a stationary state and after exposure of 10,000 Mrad, they became so viscous that they were hardly suitable for use as lubricants. However, as Table 3 shows, the greases that employed bentonite as a thickening agent in combination with these oils used as base oils remained intact even after exposure to 10,000 Mrad of radiation. In these greases, the base oils were confined in the gel structure formed by their interaction with bentonite and would not easily diffuse or become fluidized. In addition, the diffusion of aerial oxygen into the greases would have ben suppressed. As a result, small amounts of free acids would have formed and degradation would have been retarded as compared with the case where the base oils were directly exposed to radiation in the air.

As Table 4 shows, each of the commercial products of radiation-resistant grease solidified upon exposure to 500 Mrad at 150° C. because the base oils in the greases were propably cross-linked by the effects of heat and radiation. The samples of Comparative Examples 8 and 9 wherein m-(m-phenoxyphenoxy)diphenyl used as a base oil was combined with urea and silica gel, respectively, liquefied as a result of exposure to 5,000 Mrad at room temperature. They also liquefied upon exposure to 500 Mrad at 150° C. It was therefore clear that the deterioration of greases using urea or silica gel as a thickening agent was markedly accelerated as a result of increase in temperature.

In contrast, the greases of Examples 1 to 7 were found to have superior radiation resistance at high temperatures since they remained substantially intact after exposure to 500 Mrad of radiation at 150° C.

TABLE 1

| | Before irradiation | | | |
|---|---|---|---|---|
| | viscosity at 40° C. $\eta_0$[cSt] | | total acid number (mg KOH/g) | flash point (°C.) |
| Comp. Example 1 | 124.0 | | 0.00 | 258 |
| 2 | 286.0 | | 0.00 | 282 |
| 3 | 60.0 | | 0.00 | 300 |
| 4 | 240.0 | | 0.00 | 310 |
| | After irradiaton for 1,000 Mrad | | | |
| | viscosity at 40° C. $\eta$[cSt] | $\eta/\eta_0$ | total acid number (mg KOH/g) | flash point (°C.) |
| Comp. Example 1 | 162.3 | 1.31 | 0.04 | 256 |
| 2 | 477.6 | 1.67 | 0.18 | 288 |
| 3 | 105.2 | 1.75 | 0.27 | 296 |
| 4 | 408.0 | 1.70 | 0.26 | 308 |
| | After irradiaton for 3,000 Mrad | | | |
| | viscosity at 40° C. $\eta$[cSt] | $\eta/\eta_0$ | total acid number (mg KOH/g) | flash point (°C.) |
| Comp. Example 1 | 285.3 | 2.30 | 0.04 | 256 |
| 2 | 1372 | 4.80 | 0.59 | 308 |
| 3 | 360.1 | 6.00 | 0.68 | 294 |
| 4 | 1289 | 5.37 | 0.64 | 308 |
| | After irradiaton for 10,000 Mrad | | | |
| | | | total acid | flash |

TABLE 1-continued

| | viscosity at 40° C. η[cSt] | η/η0 | number (mg KOH/g) | point (°C.) |
|---|---|---|---|---|
| Comp. Example 1 | 3354 | 27.0 | 0.73 | 246 |
| 2 | 10868 | 38.0 | 0.99 | 306 |
| 3 | 4566 | 76.1 | 1.62 | 280 |
| 4 | 16680 | 69.5 | 1.50 | 292 |

Conditions of irradiation: One hundred and fifty milliliters of one of the base oils to be used in the present invention was placed in a 200-ml beaker and irradiated at room temperature with gamma-rays from $^{60}Co$ at a dose rate of 1 Mrad/hr.

TABLE 2

| | |
|---|---|
| *1 | m-(m-phenoxyphenoxy)diphenyl |
| *2 | pentaphenyl ether |
| *3 | monoalkyltriphenyl ether, with 18 carbon atoms in the alkyl group |
| *4 | monoalkyltetraphenyl ether, with 18 carbon atoms in the alkyl group |
| *5 | propylene carbonate |
| *6 | stirred at 60° C. after addition of a gelling aid |
| *7 | stirred at 80° C. after addition of a gelling aid |
| *8 | commercial grease composed of a petroleum-based lubricating oil and a lithium soap |
| *9 | commercial radiation-resistant grease composed of a petroleum-based lubricating oil and a silica gel |
| *10 | commercial radiation-resistant grease composed of a synthetic lubricating oil and sodium-octadecyl terephthalamate |
| *11 | grease composed of m-(m-phenoxyphenoxy)diphenyl and urea |
| *12 | grease composed of m-(m-phenoxyphenoxy)diphenyl and silica gel |

TABLE 3

| | Before irradiation worked penetration | oil separation (%) | free acid (%) | dropping point (°C.) | After irradiation for 1,000 Mrad worked penetration | oil separation (%) | free acid (%) | dropping point (°C.) |
|---|---|---|---|---|---|---|---|---|
| Example 1*1 | 343 | 7.1 | 0.0 | ≧300 | 406 | 7.2 | 1.4 | ≧300 |
| 2*2 | 332 | 2.3 | 0.0 | ≧300 | 360 | 2.5 | 1.5 | ≧300 |
| 3*3 | 313 | 0.5 | 0.0 | ≧300 | 328 | 0.6 | 1.8 | ≧300 |
| 4*4 | 269 | 0.0 | 0.0 | ≧300 | 270 | 0.7 | 2.1 | ≧300 |
| 5*1,5 | 380 | 3.3 | 0.0 | ≧300 | 426 | 3.7 | 1.9 | ≧300 |
| 6*1,6 | 378 | 2.6 | 0.0 | ≧300 | 410 | 3.1 | 2.7 | ≧300 |
| 7*1,7 | 381 | 2.7 | 0.0 | ≧300 | 432 | 3.9 | 2.5 | ≧300 |
| Comp. 5*8 | 269 | 0.6 | 0.1 | 175 | | liquefied at 620 Mrad | | |
| Example 6*9 | 306 | 0.5 | 0.3 | ≧300 | 406 | 1.1 | 17.8 | ≧300 |
| 7*10 | 306 | 0.6 | 0.4 | 260 | 411 | 8.6 | 6.4 | 168 |
| 8*11 | 284 | 3.4 | 0.0 | ≧300 | 281 | 6.3 | 1.1 | ≧300 |
| 9*12 | 283 | 0.4 | 0.4 | ≧300 | 372 | 1.8 | 2.0 | ≧300 |

| | After irradiation for 3,000 Mrad worked penetration | oil separation (%) | free acid (%) | dropping point (°C.) | After irradiation for 10,000 Mrad worked penetration | oil separation (%) | free acid (%) | dropping point (°C.) |
|---|---|---|---|---|---|---|---|---|
| Example 1*1 | 400 | 7.3 | 1.9 | ≧300 | 400 | 8.5 | 2.7 | ≧300 |
| 2*2 | 372 | 2.7 | 2.2 | ≧300 | 360 | 4.0 | 3.0 | ≧300 |
| 3*3 | 338 | 0.8 | 2.6 | ≧300 | 336 | 1.0 | 3.2 | ≧300 |
| 4*4 | 283 | 0.0 | 2.8 | ≧300 | 280 | 0.0 | 3.5 | ≧300 |
| 5*1,5 | 428 | 3.9 | 2.7 | ≧300 | 312 | 1.0 | 3.8 | ≧300 |
| 6*1,6 | 412 | 3.2 | 3.9 | ≧300 | 282 | 0.6 | 5.2 | ≧300 |
| 7*1,7 | 420 | 3.5 | 3.4 | ≧300 | 252 | 0.0 | 4.5 | ≧300 |
| Comp. 5*8 | | | | liquefied at 620 Mrad | | | | |
| Example 6*9 | | | | solidified at 2,000 Mrad | | | | |
| 7*10 | 418 | 44.5 | 14.9 | 140 | | solidified at 4,000 Mrad | | |
| 8*11 | 380 | 3.7 | 2.3 | ≧300 | | solidified at 5,000 Mrad | | |
| 9*12 | 378 | 0.6 | 3.4 | ≧300 | | solidified at 5,000 Mrad | | |

TABLE 4

| | Before irradiation worked penetration | oil separation (%) | free acid (%) | dropping point (°C.) |
|---|---|---|---|---|
| Example 1 | 343 | 7.1 | 0.0 | ≧300 |
| 2 | 332 | 2.3 | 0.0 | ≧300 |

TABLE 4-continued

| | | | | |
|---|---|---|---|---|
| 3 | 313 | 0.5 | 0.0 | ≧300 |
| 4 | 269 | 0.0 | 0.0 | ≧300 |
| 5 | 380 | 3.3 | 0.0 | ≧300 |
| 6 | 378 | 2.6 | 0.0 | ≧300 |
| 7 | 381 | 2.7 | 0.0 | ≧300 |
| Comp. 5 | 269 | 0.6 | 0.1 | 175 |
| Example 6 | 306 | 0.5 | 0.3 | ≧300 |
| 7 | 306 | 0.6 | 0.4 | 260 |
| 8 | 284 | 3.4 | 0.0 | ≧300 |
| 9 | 283 | 0.4 | 0.4 | ≧300 |

| | After irradiation for 500 Mrad at 150° C. worked penetration | oil separation (%) | free acid (%) | dropping point (°C.) | evaporation (%) |
|---|---|---|---|---|---|
| Example 1 | 302 | 0.7 | 2.6 | ≧300 | 14.2 |
| 2 | 290 | 0.4 | 2.6 | ≧300 | 13.1 |
| 3 | 267 | 0.2 | 2.7 | ≧300 | 16.3 |
| 4 | 213 | 0.0 | 2.8 | ≧300 | 13.2 |
| 5 | 330 | 1.1 | 3.2 | ≧300 | 5.3 |
| 6 | 338 | 1.2 | 3.6 | ≧300 | 3.1 |
| 7 | 346 | 1.3 | 4.0 | ≧300 | 1.2 |
| Comp. 5 | | | solidified | | |
| Example 6 | | | solidified | | |
| 7 | | | solidified | | |
| 8 | | | liquified | | |
| 9 | | | liquified | | |

According to the present invention, a base oil having good radiation resistance is combined with a bentonite-based thickening agent which is used either alone or in admixture with a specified gelling aid. As a result, the high-temperature performance of the base oil is improved to provide a grease that is not only radiation-resistant but also heat-resistant. Therefore, the radiation-resistant grease of the present invention is expected to perform satisfactorily when used in a mechanical snubber or a limit switch or any other device that is to be used in a site where large doses of radiation are scheduled to be applied or which is to be used under irradiation and at high temperatures.

What is claimed is:

1. Radiation-resistant grease composed of:

(A) 70–97wt % of a base oil composed of a component selected from the group consisting of: m-(m-phenoxyphenoxy)diphenyl, pentaphenyl ether, a monoalkyltriphenyl ether and a monoalkyltetraphenyl ether, provided that the alkyl group contains 6–20 carbon atoms; and (B) 3–30 wt % of a bentonite based thickening agent.

2. Radiation-resistant grease composed of:

(A) 60–96.5 wt % of a base oil composed of a component selected from the group consisting of: m-(m-phenoxyphenoxy)diphenyl, pentaphenyl ether, a monoalkyltriphenyl ether and a monoalkyltetraphenyl ether, provided that the alkyl group contains 6–20 carbon atoms;

(B) 3–30 wt % of a bentonite based thickening agent; and (C) 0.5–10 wt % of at least one gelling aid selected from the group consisting of an aliphatic alcohol having 1–5 carbon atom, an aliphatic ketone having 3–8 carbon atoms and an aliphatic carbonate ester having 2–5 carbon atoms in the aliphatic group.

3. A grease according to claim 1 wherein said component is selected from the group consisting of said m-(m-phenoxyphenoxy) diphenyl; said monoalkyltriphenyl ether; and said monoalkyltetraphenyl ether.

4. A grease according to claim 2 wherein said component is selected from the group consisting of said m-(m-phenoxyphenoxy) diphenyl; said monoalkyltriphenyl ether; and said monoalkyltetraphenyl ether.

* * * * *